US005757933A

United States Patent [19]

Preves et al.

[11] Patent Number: 5,757,933

[45] Date of Patent: May 26, 1998

[54] IN-THE-EAR HEARING AID WITH DIRECTIONAL MICROPHONE SYSTEM

[75] Inventors: David A. Preves, Minnetonka; Timothy S. Peterson, Lino Lakes; Mark A. Bren, Maple Grove, all of Minn.

[73] Assignee: Micro Ear Technology, Inc., Plymouth, Minn.

[21] Appl. No.: 763,520

[22] Filed: Dec. 11, 1996

[51] Int. Cl.[6] ..... H04R 25/00

[52] U.S. Cl. ..... 381/68.1; 381/68.6; 381/92

[58] Field of Search ..... 381/68, 68.1, 68.5, 381/69, 168, 169, 92, 122, 155, 68.2, 68.4, 23.1

[56] References Cited

U.S. PATENT DOCUMENTS

| | | | |
|---|---|---|---|
| 3,571,514 | 3/1971 | Wruk | 179/1 |
| 3,770,911 | 11/1973 | Knowles et al. | 179/107 S |
| 3,798,390 | 3/1974 | Gage et al. | 179/107 FD |
| 3,836,732 | 9/1974 | Johanson et al. | 179/107 FD |
| 3,875,349 | 4/1975 | Ruegg | 179/107 FD |
| 3,946,168 | 3/1976 | Preves | 179/107 FD |
| 3,975,599 | 8/1976 | Johanson | 179/107 FD |
| 4,051,330 | 9/1977 | Cole | 179/107 FD |
| 4,142,072 | 2/1979 | Berland | 179/107 FD |
| 4,456,795 | 6/1984 | Saito | 381/68.7 |
| 4,622,440 | 11/1986 | Slavin | 381/68.1 |
| 4,712,244 | 12/1987 | Zwicker et al. | 381/68.1 |
| 4,723,293 | 2/1988 | Harless | 381/68 |
| 4,751,738 | 6/1988 | Widrow et al. | 381/68.1 |
| 5,029,215 | 7/1991 | Miller, II | 381/92 |
| 5,214,709 | 5/1993 | Ribic | 381/92 |
| 5,226,087 | 7/1993 | Ono et al. | 381/92 |
| 5,289,544 | 2/1994 | Franklin | 381/68.1 |
| 5,524,056 | 6/1996 | Killion et al. | 381/68.1 |

*Primary Examiner*—Huyen D. Le

*Attorney, Agent, or Firm*—Nawrocki, Rooney & Sivertson, P.A.

[57] ABSTRACT

Apparatus for use as an in-the-ear hearing aid. The apparatus includes a housing having a shell and a face plate, wherein the shell is molded to custom fit a hearing aid user's ear. A first non-directional microphone system is included having a first output signal representative of the sound received. A second non-directional microphone system is included having a second output signal representative of the sound received. A switch mechanism is included having an operator extending through the housing for switching the in-the-ear hearing aid between a non-directional mode and a directional mode. In the directional mode, the microphone system is adjustable between a cardioid and super cardioid polar output pattern.

21 Claims, 4 Drawing Sheets

IN-THE-EAR HEARING AID WITH DIRECTIONAL MICROPHONE SYSTEM

BACKGROUND OF THE INVENTION

The present invention relates to a microphone system which may be used with an in-the-ear hearing aid system. In particular, the present invention relates to an adjustable microphone system, which may be used with an in-the-ear hearing aid, which allows the user to switch between a non-directional (or omni-direction) mode or a directional mode.

Typical hearing aids either include a non-directional or directional hearing aid microphone system. A non-directional hearing aid system allows the user to pickup sounds from any direction. When a hearing aid user is trying to carry on a conversation within a crowded room, a non-directional hearing aid system does not allow the user to easily differentiate between the voice of the person the user is talking to and background or crowd noise. A directional hearing aid helps the user to hear the voice of the person they are having a conversation with, while reducing the miscellaneous crowd noise present within the room.

Traditionally, directional hearing aids are implemented with a single microphone having inlets to cavities located in front and back of a diaphragm. Directionality with a single microphone is accomplished with an acoustic resistor placed across a hole in the back inlet of the microphone acting in combination with the compliance formed by the volume of air behind the diaphragm. This system is termed a first order pressure gradient directional microphone because the microphone output is a function of the pressure differential across the diaphragm.

One measure of the amount of directivity of a directional hearing aid system is a polar directivity pattern 10 as shown in FIG. 1. The polar directivity pattern 10 shows the amount of pickup at a specific frequency (in terms of gain attenuation in dB) of a directional hearing aid system as a function of azimuth angle of sound incidence. Accurate measurement of a polar directivity pattern requires an anechoic chamber. An anechoic chamber is an enclosed room that has minimum reflection of sound from its inner wall surfaces and attenuates ambient sounds entering from the outside. Thus, inside an anechoic chamber, the direction of arrival of sound can be controlled so that it comes from only one specific angle of incidence.

A cardioid or heart-shaped polar pattern (FIG. 1) produces a directivity index of about 3–4 dB. The directivity index is the ratio of energy arriving from in front of the hearing aid wearer to random energy incident from all directions around an imaginary sphere with the hearing aid at its center. However, a super cardioid polar pattern 14, as shown in FIG. 2, which can also be obtained with a first order gradient directional hearing aid microphone, produces a 5–6 dB directivity index. It has been found that producing a super-cardioid polar pattern 14 requires 1.72 times greater front-to-rear microphone inlet spacing than a cardioid polar pattern 12. The amount of space available for front-to-rear microphone spacing is limited by the physical size of the individual's ear. Because of limited space, a super cardioid directivity pattern is more difficult to achieve using a single directional microphone in a full-concha custom in-the-ear hearing aid device.

Conventional behind-the-ear type hearing aids have included a main body and a hook extending from the main body and arrange to engage the upper end of the ear lobe of the user to hang the main body on the ear. Known versions of behind-the-hearing aids that had variable amounts of directionality use mechanical shutters or valves to adjust the amount of directionality. For example, see U.S. Pat. No. 3,798,390 to Gage et al.; U.S. Pat. No. 3,836,732 to Johanson et al.; and U.S. Pat. No. 4,051,330 to Cole. Other known behind-the-ear hearing aid systems, such as U.S. Pat. No. 5,214,709 to Ribic suggests a behind-the-ear hearing aid system which includes the use of more than one non-directional microphone to make a directional microphone behind-the-ear hearing aid system.

It is desirable to have an in-the-ear hearing aid system which allows the user to switch between a non-directional (omni-directional) and a directional hearing aid mode. Further, it is desirable to have an in-the-ear hearing aid system having an adjustable directional microphone system, wherein the adjustable directional microphone system is adjustable between a cardioid polar directivity pattern and a super cardioid polar directivity pattern as required by the individual user. Further, it is desirable to have an in-the-ear hearing aid microphone system having an adjustable directional microphone system to allow compensation for small ears where the microphone inlets cannot be spaced far apart. It is also desirable to have an in-the-ear hearing aid microphone system which allows the in-the-ear hearing aid microphone system to be adjusted for manufacturing tolerances between the individual microphones.

SUMMARY OF THE INVENTION

The present invention includes an apparatus for use as an in-the-ear hearing aid. The apparatus includes a housing having a shell and a face plate, wherein the shell is molded to custom fit a hearing aid user's ear. A first non-directional microphone system is included having a first inlet opening in the face plate for receiving sound, and having a first output signal representative of the sound received. A second non-directional microphone system is included having a second inlet opening in the face plate for receiving sound and having a second output signal representative of the sound received. A switch mechanism is provided having an operator extending through the housing for switching the in-the-ear hearing aid between a non-directional mode and a directional mode.

The switch has an open position and a closed position. When the switch is in the closed position, the in-the-ear hearing aid operates in a directional mode. When the switch is in an open position, the in-the-ear hearing aid operates in a non-directional mode.

The apparatus may further include means for summing, selectively coupled to the first non-directional microphone system and the second non-directional microphone system, having a summed output signal representative of the sum of the first output signal and the second output signal. When the hearing aid is in the directional mode, the output signal has a polar directivity pattern representative of the summed output signal, the means for summing may further comprise means for adjusting the polar directivity pattern of the summed output signal between a cardioid polar directivity pattern and a super cardioid polar directivity pattern. The means for adjusting the polar directivity pattern may include an inverting amplifier coupled to the second microphone system, and an adjustable low pass filter coupled to the inverting amplifier. In one embodiment, the adjustable phase delay includes an adjustable phase delay having an adjustable capacitor. The means for adjusting the polar directivity may further include an adjustable amplifier coupled to the second microphone system.

In one embodiment, the first inlet opening and the second inlet opening are relatively close together. In one particular embodiment, the first inlet opening and second inlet opening are less than ½ inch apart, and the first inlet opening and the second inlet opening are located in approximately the same line, which is generally horizontal to the ground when the in-the-ear hearing aid is located in a user's ear.

In another embodiment, the present invention includes a microphone system for use with an in-the-ear hearing aid. The system includes a first non-directional microphone system having a first inlet opening for receiving sound and having a first output signal representative of the sound received. A second non-directional microphone system is included having a second inlet opening for receiving sound having a second output signal representative of the sound received. Means are provided for coupling the first non-directional microphone system to the second non-directional microphone system for switching the in-the-ear hearing aid between a non-directional mode and a directional mode.

The means for coupling may be a switch having a closed position and an open position, and wherein when the switch is in the open position, the in-the-ear hearing aid is in the non-directional mode, and when the switch is in a closed position, the in-the-ear hearing aid is in a directional mode.

The second non-directional microphone system may further include means for inverting the second output signal. The second non-directional microphone system may further include means for adjusting the phase delay of the second output signal relative to the first output signal. The means for adjusting the phase delay may include a phase delay having an adjustable capacitor. Further, the second non-directional microphone system may further include means for adjusting the amplitude of the first output signal relative to the second output signal.

The present invention may include means for summing the first output signal and the second output signal. The means for summing may have an output coupled to an amplifier. The amplifier may include a phase delay.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 3:
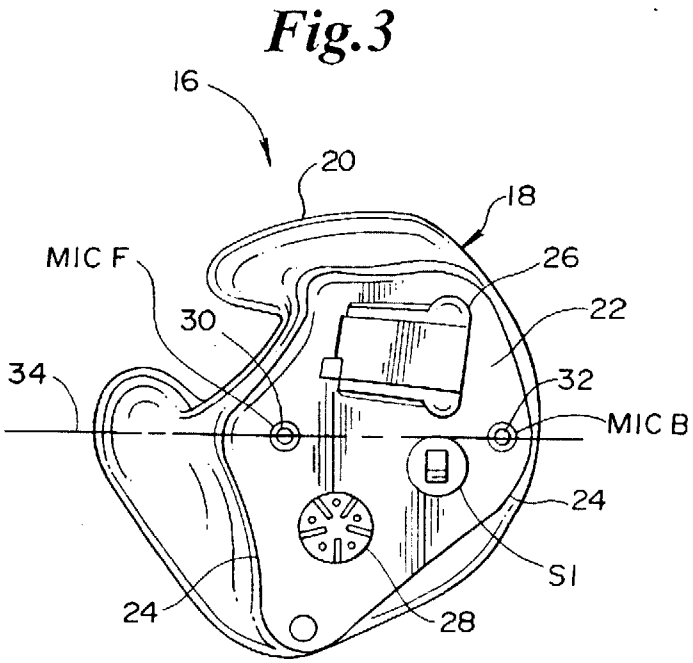
FIG. 3 is a perspective view of an in-the-ear hearing aid in accordance with the present invention.

In FIG. 3, an in-the-ear hearing aid is generally shown at 16. The in-the-ear (ITE) hearing aid 16 includes a housing 18 having a face plate 22 and a molded shell 20. The molded shell 20 is adhered to the face plate 22, indicated along line 24. The molded shell 20 is custom molded to fit each individual hearing aid wearer by known processes, such as making an impression of the individual hearing aid user's ear and forming the molded shell based on that impression. The face plate 22 is coupled to a circuit board (not shown) located inside the ITE hearing aid 16, which contains the circuitry for the hearing aid device.

Extending through the in-the-ear hearing aid 16 and specifically face plate 22, is a battery door 26, a volume control 28, a switch S1, a microphone mic F, and a microphone mic B. The battery door 26 allows the hearing aid user access to the in-the-ear hearing aid 16 for changing the battery (not shown). The volume control 28 allows the hearing aid user to adjust the volume or amplification level of the hearing aid 16.

Switch S1 extends through the housing 18 and specifically face plate 22. Switch S1 allows the hearing aid user to manually switch the in-the-ear hearing aid 16 between a non-directional or directional hearing aid mode. Switch S1 is electronically coupled to the circuit contained within the in-the-ear hearing aid 16, which will be described in further detail later in the specification. With the novel idea of switch S1, a hearing aid user can switch to a non-directional hearing aid mode to hear sounds from all directions, or a directional hearing aid mode, such as for reducing background noise when carrying on a conversation in a crowded room.

Microphone mic F and microphone mic B include inlet tubes 30, 32 which protrude through the in-the-ear hearing aid face plate 22. Microphone mic F and microphone mic B are spaced a relatively short distance apart, preferably less than 1 inch. In one preferred embodiment, microphone mic F and microphone mic B are preferably 7/16 of an inch apart (less than ½ an inch apart).

An axis of directionality is defined by a line drawn through the inlet tube 30 and inlet tube 32 in face plate 22, indicated at 34. The in-the-ear hearing aid 16 in accordance with the present invention is of a molded design such that the axis of directionality 34 is relatively horizontal to the floor when the in-the-ear hearing aid 16 is positioned within the hearing aid 16 user's ear. With this design, optimum performance of the in-the-ear hearing aid 16 is achieved.

Figure 4:
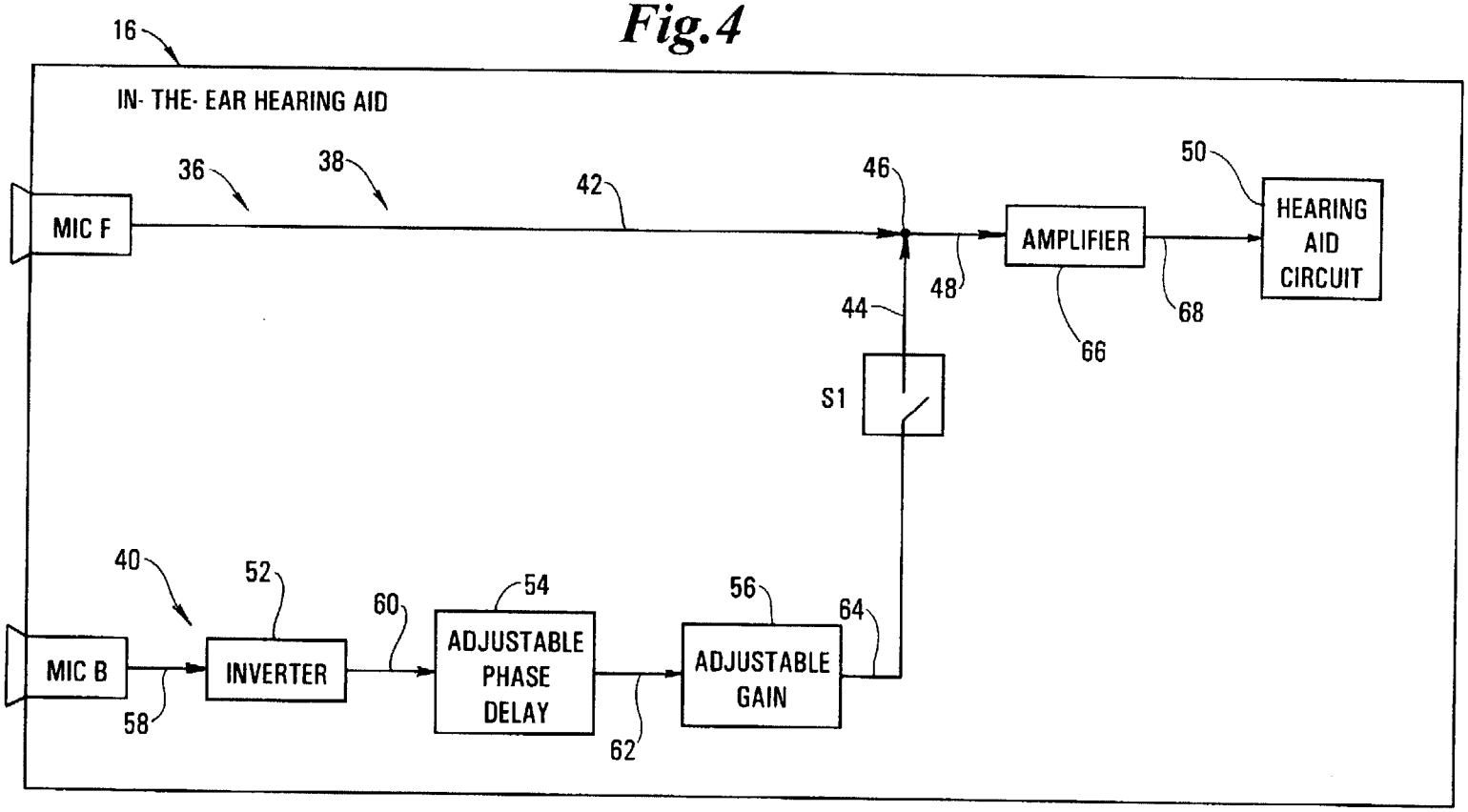
FIG. 4 is a system block diagram of one embodiment of the hearing aid in accordance with the present invention.

Referring to FIG. 4, a block diagram showing the directional microphone system in accordance with the present invention, for use with an in-the-ear hearing aid 16 is generally shown at 36. The directional microphone system 36 utilizes two non-directional microphone circuits to achieve a directional microphone signal. The directional microphone system 36 includes a first non-directional microphone system 38 and a second non-directional microphone system 40. The output signals from the first non-directional microphone system 38 and second non-directional microphone system 40 (indicated by signal 42 and signal 44) may be electrically coupled through switch S1, and summed at node 46. The resulting output signal is indicated at 48. The output signal 48 is electrically coupled to a hearing aid circuit 50. For example, the hearing aid circuit 50 may be a linear circuit, a compression circuit, an adaptive high-pass filter, and may include a high-power output stage.

The in-the-ear hearing aid 16 may be switched between a non-directional mode and a directional mode through the operation of switch S1. In the non-directional mode switch S1 is open (as shown), and non-directional microphone mic F feeds directly into hearing aid circuit 50. For operation in a directional mode, switch S1 is closed, and the first non-directional microphone system 38 and second non-directional microphone system 40 output signals 42 and 44 are summed at summing node 46, with the resulting output signal 48 being coupled to hearing aid circuit 50.

In one embodiment, the second non-directional microphone system 40 includes non-directional microphone mic B, an inverter 52, an adjustable phase delay 54, and an adjustable gain 56. The output signal of microphone mic B is coupled to inverter 52, indicated at 58. The output signal of inverter 52 is coupled to the adjustable phase delay 54, indicated at 60. The output of adjustable phase delay 54 is coupled to the adjustable gain 56, indicated at 62. The output of the adjustable gain 56 is coupled to switch S1, indicated at 64.

Figure 1:
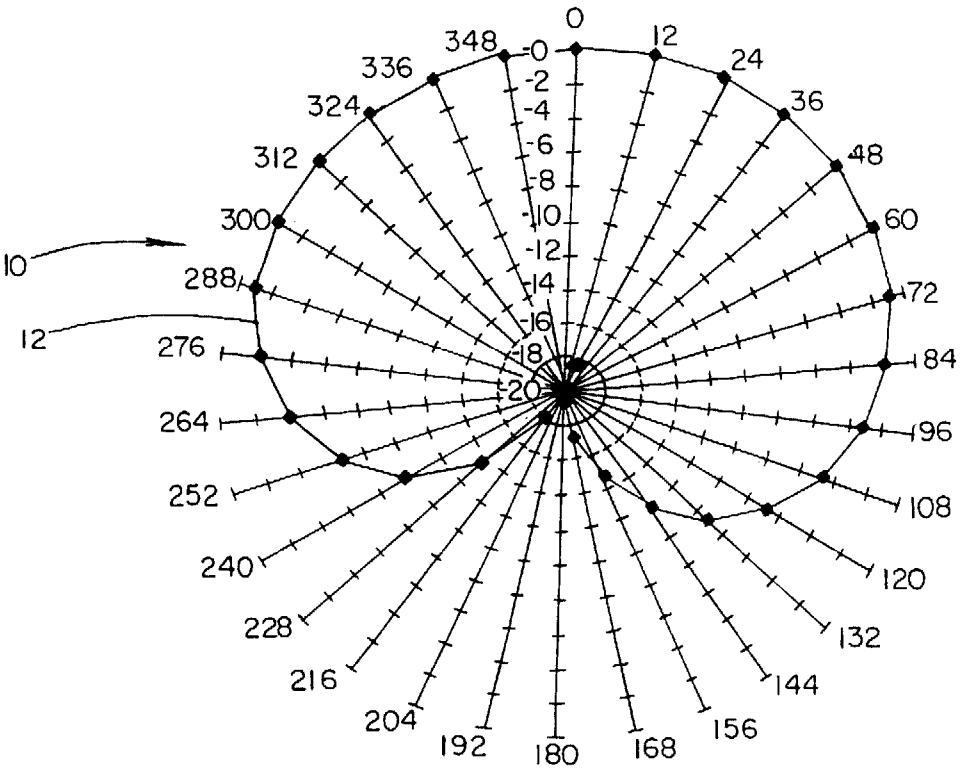
FIG. 1 is a cardioid polar directivity pattern of an in-the-ear hearing aid.
Figure 2:
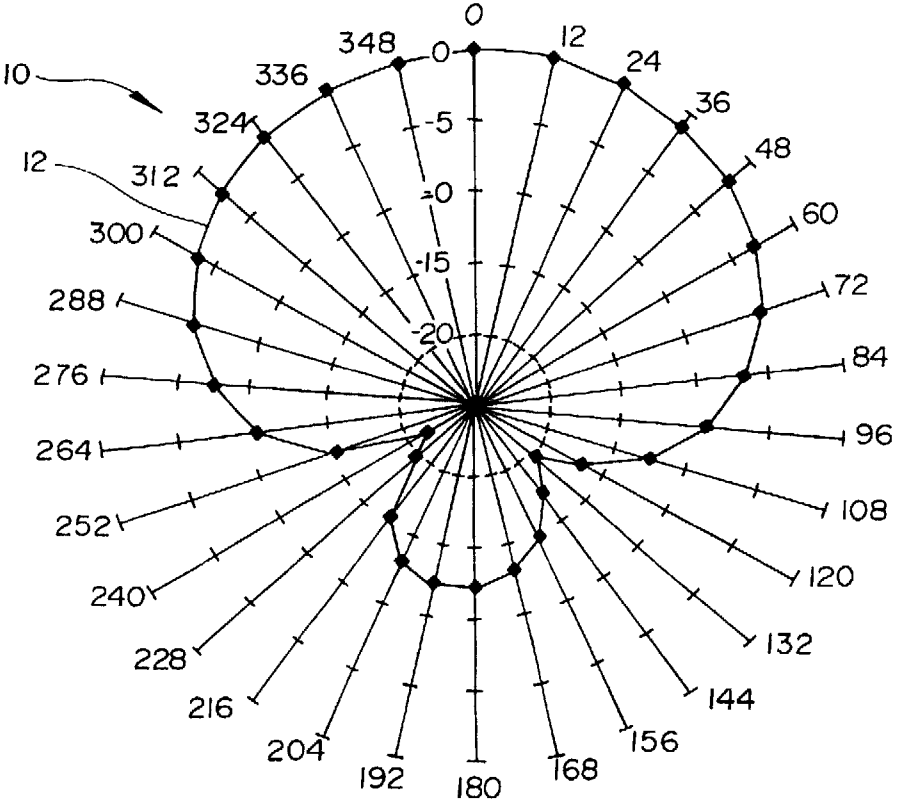
FIG. 2 is a super cardioid polar directivity pattern of an in-the-ear hearing aid.

The output signal 58 of microphone mic B is inverted by inverter 52. Further, when switch S1 is closed, the adjustable phase delay 54 may be adjusted to adjust the phase delay of the output of mic B relative to the output of microphone mic F. Similarly, adjustable gain 56 adjusts the amplitude of the output signal received from mic B relative to the output signal 42 from microphone mic F. By providing such adjustment, the hearing aid manufacturer and/or the hearing aid dispenser may vary the polar directivity pattern of the in-the-ear hearing aid from a cardioid polar pattern 12 (shown in FIG. 1) to a super cardioid polar pattern 14 (shown in FIG. 2), as desired by the individual hearing aid wearer.

Although a super cardioid pattern is normally desired, the adjustable non-directional microphone system 40 allows the cardioid pattern to be adjusted for compensation for small ears which do not allow larger inlet spacing. Further, the adjustable non-directional microphone system 40 allows for adjustments to compensate for the differences in manufacturing tolerances between non-directional microphone mic F and non-directional microphone mic B.

The output signal 48 from first non-directional microphone system 38 and second non-directional microphone system 40 may be amplified by passing it through an amplifier 66. The resulting output signal of amplifier 66, indicated at 68, is coupled to the hearing aid circuit 50.

Figure 5:
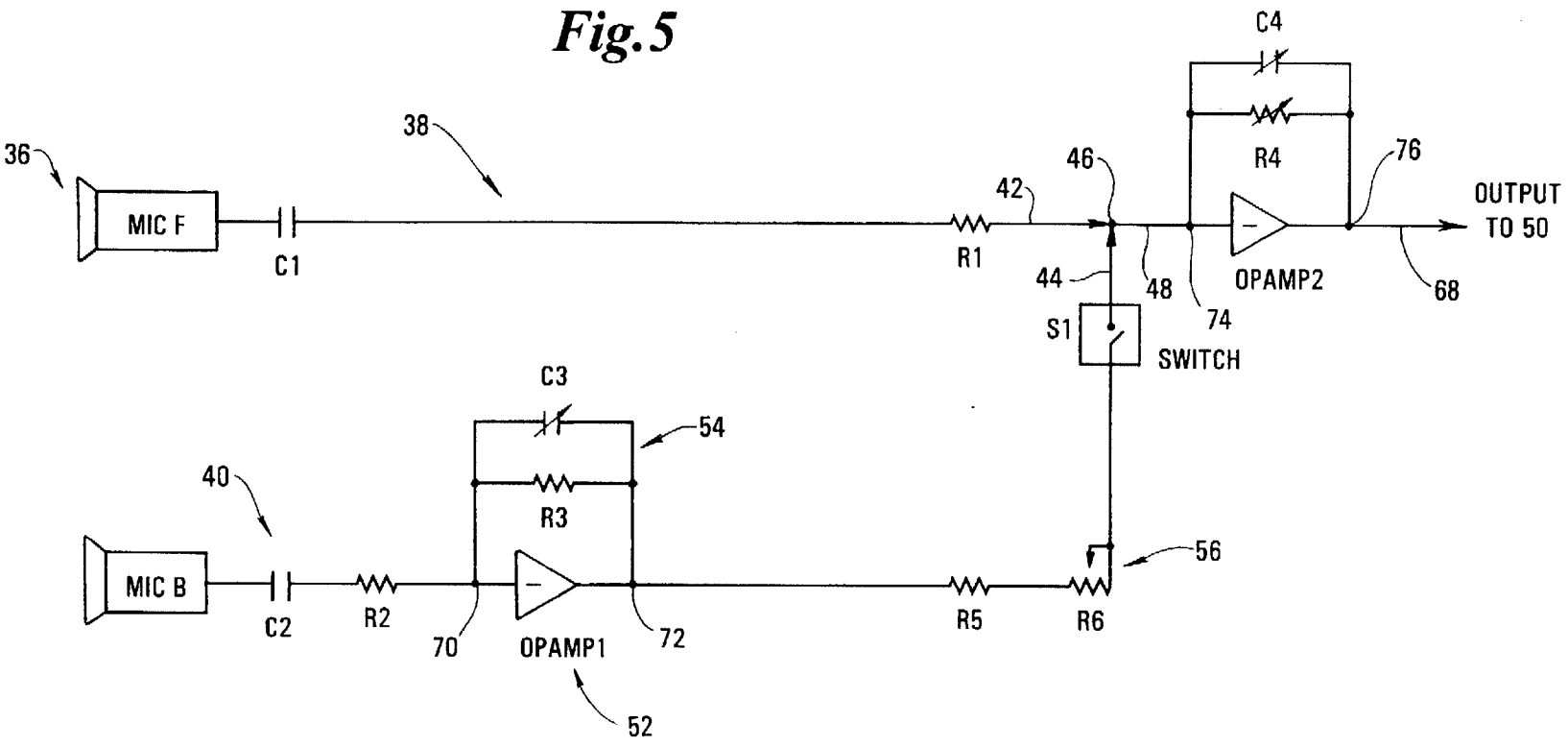
FIG. 5 is a schematic circuit diagram of one embodiment of the in-the-ear hearing aid in accordance with the present invention.

Referring to FIG. 5, a schematic diagram of one preferred embodiment of the-in-ear hearing aid directional microphone system 36 is shown. Non-directional microphone mic F has a coupling capacitor Cl coupled to its output. Resistor R1 is electrically coupled between coupling capacitor C1 and summing node 46. Non-directional microphone mic B has a coupling capacitor C2 coupled to its output. Coupled to the output of C2 is inverter 52 with adjustable phase delay 54. The adjustable phase delay is an adjustable low pass filter. The inverter 52 is an operational amplifier OPAMP 1, shown in an inverting configuration. Coupled between capacitor C2 and the input node 70 of OPAMP 1 is resistor R2. Coupled between OPAMP 1 input node 70 and an OPAMP 1 output node 72 is resistor R3. Similarly, coupled between OPAMP 1 input node 70 and OPAMP 1 output node 72 is a capacitor C3.

As previously described herein, OPAMP 1 inverts the output signal received from non-directional microphone mic B. As such, when the output signal 42 and output signal 44 are summed at summing node 46, the signals are subtracted, resulting in output signal 48.

The gain between the input of OPAMP 1 and the output of OPAMP 1 is indicated by the relationship R3/R2. In one preferred embodiment, R3 equals R2, resulting in a unity gain output signal from OPAMP 1.

The phase delay 54 low pass filter capacitor C3 may be adjustable. By adjusting capacitor C3, the phase delay of the non-directional microphone mic B output relative to the non-directional microphone mic F may be adjusted. Coupled to the output node 72 of OPAMP 1 is a resistor R5 in series with an adjustable resistor or potentiometer R6. Further, coupled to output signal 48 is an inverting operational amplifier, OPAMP 2 having an input node 74 and an output node 76. Coupled between the input node 74 and the output node 76 is resistor R4. Also coupled between the input node 74 and the output node 76 is a capacitor C4. It is recognized that capacitor C4 and resistor R4 may also be adjustable.

When switch S1 is open, the resulting amplification or gain from the output from non-directional microphone mic F is the ratio of resistors R4/R1. When switch S1 is closed, the output gain contribution from mic B is determined by the ratio of R4/(R5 plus R6). By adjusting the adjustable potentiometer R6, the amplitude of non-directional microphone mic B of the output signal relative to the output signal amplitude of non-directional microphone mic F may be adjusted. As previously stated herein, by adjusting both capacitor C3 and resistor R6, the hearing aid may be adjusted to vary the polar directivity pattern of the in-the-ear hearing aid from cardioid (FIG. 1) to super cardioid (FIG. 2), as desired.

In one preferred embodiment, the values for the circuit components shown in FIG. 5 are as follows:

TABLE 1

| |
|---|
| C1 = .01 μF |
| C2 = .01 μF |
| C3 = .0022 μF |
| C4 = 110 pF |
| R1 = 10K |
| R2 = 10K |
| R3 = 10K |
| R4 = 1M |
| R5 = 10K |
| R6 = 2.2K |

Non-directional microphone mic F and non-directional microphone mic B can be non-directional microphones as produced by Knowles No. EM5346. Operational amplifiers OPAMP 1 and OPAMP 2 may be inverting Gennum Hearing Aid Amplifiers No. 1/4 LX509.

The hearing aid in accordance with the present invention allows a person wearing an in-the-ear hearing aid to switch between a non-directional mode and a directional mode by simple operation of switch S1 located on the in-the-ear hearing aid 16. The circuit components which makeup the directional microphone system 36 and the hearing aid circuit 50 are all located within the hearing aid housing 18 and coupled to the inside of face plate 22. Further, by adjustment of the adjustable phase delay 54 and adjustable gain 56, the directional microphone system 36 may be adjusted to vary the polar directivity pattern from cardioid to super cardioid. It may be desirable to adjust the polar directivity pattern between cardioid and super cardioid for various reasons, such as to compensate for limited inlet spacing due to small ears, to compensate for the manufacturing tolerances between non-directional microphone mic F and non-directional microphone mic B, or to fine tune the hearing aid microphone as desired by the individual. It is also recognized that capacitor C4 and resistor R4 may be adjustable to compensate for each individual's hearing loss situation.

With the novel design of the present invention, the associated circuitry of the present invention allows the two non-directional microphones mic B and mic F to be positioned very close together and still produce a directional microphone system having a super cardioid polar directivity pattern. Further, the directional microphone system in accordance with the present invention is able to space the two microphones less than one inch apart, and in a preferred embodiment, 7/16 of an inch apart in order for the directional microphone system in accordance with the present invention to be incorporated into an in-the-ear hearing aid device. The in-the-ear hearing aid 16 circuitry, including the directional microphone system 36 circuitry and the hearing aid circuit 50 circuitry, utilize microcomponents and may further utilize printed circuit board technology to allow the directional microphone system 36 and hearing aid circuit 50 to be located within a single in-the-ear hearing aid 16.

It will be understood that this disclosure is, in many respects, only illustrative. Changes may be made in details, particularly in matters of shape, size, material, and arrangement of parts, without exceeding the scope of the invention. Accordingly, the scope of the invention is as defined in the language of the appended claims.

What is claimed is:

1. An apparatus for use as an in-the-ear hearing aid, the apparatus comprising:

a housing having a shell and a face plate, wherein the shell is molded to custom fit a hearing aid user's ear;

a first non-directional microphone system having a first inlet opening in the face plate for receiving sound and having a first output signal representative of the sound received;

a second non-directional microphone system having a second inlet opening in the face plate for receiving sound and having a second output signal representative of the sound received; and switch means having an operator extending through the housing for switching the in-the-ear hearing aid between a non-directional mode and a directional mode.

2. The apparatus of claim 1, wherein the switch has an open position and a closed position, and wherein when the switch is in the closed position, the in-the-ear hearing aid operates in a directional mode.

3. The apparatus of claim 2, wherein when the switch is in an open position, the hearing aid operates in a non-directional mode.

4. The apparatus of claim 2, further comprising means for summing, selectively coupled to the first non-directional microphone system and the second non-directional microphone, having a summed output signal representative of the sum of the first output signal and the second output signal.

5. The apparatus of claim 1, wherein the first inlet opening and second inlet opening are relatively close together.

6. The apparatus of claim 1, wherein the first inlet opening and second inlet opening are less than ½ an inch apart.

7. The apparatus of claim 6, wherein the first inlet opening and second inlet opening are located in approximately the same line which is generally horizontal to the ground when the in-the-ear hearing aid is located in a user's ear.

8. An apparatus for use as an in-the-ear hearing aid, the apparatus comprising:

a housing having a shell and a face plate, wherein the shell is molded to custom fit a hearing aid user's ear;

a first non-directional microphone system having a first inlet opening in the face Plate for receiving sound and having a first output signal representative of the sound received;

a second non-directional microphone system having a second inlet opening in the face plate for receiving sound and having a second output signal representative of the sound received;

switch means having an operator extending through the housing for switching the in-the-ear hearing aid between a non-directional mode and a directional mode, wherein the switch has an open position and a closed position, and wherein, when the switch is in the closed position, the in-the-ear hearing aid operates in a directional mode; and means for summing, selectively coupled to the first non-directional microphone system and the second non-directional microphone system, having a summed output signal representative of the sum of the first output signal and the second output signal;

wherein, when the hearing aid is in the directional mode, the output signal has a polar directivity pattern representative of the summed output signal; and wherein the means for summing further comprises means for adjusting the polar directivity pattern of the summed output signal between a cardioid polar directivity pattern and a super cardioid polar directivity pattern.

9. The apparatus of claim 8, wherein the means for adjusting the polar directivity pattern includes:

an inverting amplifier coupled to the second microphone system; and an adjustable phase delay coupled to the inverting amplifier.

10. The apparatus of claim 9, wherein the adjustable phase delay includes an adjustable low pass filter having an adjustable capacitor.

11. The apparatus of claim 9, wherein the means for adjusting the polar directivity further includes an adjustable amplifier coupled to the second microphone system.

12. The apparatus of claim 9, wherein the adjustable amplifier includes an adjustable potentiometer.

13. A microphone system for use with an in-the-ear hearing aid, the system comprising:

a first non-directional microphone system having a first inlet opening for receiving sound and having a first output signal representative of the sound received;

a second non-directional microphone system having a second inlet opening for receiving sound and having a second output signal representative of the sound received; and means for electrically coupling the first non-directional microphone system to the second non-directional microphone system for electrically switching the in-the-ear hearing aid between a non-directional mode and a directional mode.

14. The system of claim 13, wherein the means for coupling is a switch having a closed position and an open position, and wherein when the switch is in the open position the in-the-ear hearing aid is in the non-directional mode, and when the switch is in a closed position, the in-the-ear hearing aid is in the directional mode.

15. The system of claim 13, wherein the second non-directional microphone system further comprising means for inverting the second output signal.

16. The system of claim 15, wherein the second non-directional microphone system further comprises means for adjusting the phase delay of the second output signal relative to the first output signal.

17. The system of claim 16, wherein the means for adjusting the phase delay includes a phase delay having an adjustable capacitor.

18. The system of claim 15, wherein the second non-directional microphone system further comprises means for adjusting the amplitude of the first output signal relative to the second output signal.

19. The system of claim 13, further comprising means for summing the first output signal and the second output signal.

20. The system of claim 19, wherein the means for summing has an output coupled to an amplifier.

21. The system of claim 20, wherein the amplifier includes a phase delay.

* * * * *

UNITED STATES PATENT AND TRADEMARK OFFICE

CERTIFICATE OF CORRECTION

PATENT NO.: 5,757,933

DATED: May 26, 1998

INVENTOR(S) : David A. Preves, Timothy S. Peterson, Mark A. Bren

It is certified that error appears in the above-identified patent and that said Letters Patent is hereby corrected as shown below:

In column 7, line 34, please insert "electrically" before "switching".

Signed and Sealed this

Fifteenth Day of May, 2001

*Attest:*

Nicholas P. Godici

NICHOLAS P. GODICI

*Attesting Officer*

*Acting Director of the United States Patent and Trademark Office*